United States Patent [19]

Taylor

[11] 4,017,265

[45] Apr. 12, 1977

[54] FERROMAGNETIC MEMORY LAYER, METHODS OF MAKING AND ADHERING IT TO SUBSTRATES, MAGNETIC TAPES, AND OTHER PRODUCTS

[76] Inventor: David W. Taylor, P.O. Box 67, Providence Road, Edgemont, Pa. 19028

[22] Filed: Feb. 15, 1972

[21] Appl. No.: 226,512

[52] U.S. Cl. ..... 428/675; 204/20; 204/30; 204/28; 204/29; 204/38 B; 204/38 E; 204/48; 340/174 TF; 427/304; 427/305; 427/306; 427/132; 428/928

[51] Int. Cl.[2] ..... C25D 5/56; C25D 5/00; C25D 5/10; C25D 5/24

[58] Field of Search ..... 204/38 B, 38 E, 29, 204/30, 48, 20; 117/47 R, 130 E, 71, 227, 218, 235–240; 29/195 R, 199, DIG. 12, 203 MM; 106/1; 274/41.4; 340/174 TF

[56] References Cited

UNITED STATES PATENTS

| | | | |
|---|---|---|---|
| 2,619,454 | 11/1952 | Zapponi | 204/48 |
| 3,226,256 | 12/1965 | Schneble et al. | 117/212 |
| 3,227,635 | 1/1966 | Koretzky et al. | 204/48 |
| 3,269,854 | 8/1966 | Hei | 274/41.4 |
| 3,485,725 | 12/1969 | Koretzky | 204/48 |
| 3,488,166 | 1/1970 | Kovac et al. | 29/195 P |
| 3,518,170 | 6/1970 | Koretzky | 204/48 |
| 3,523,824 | 8/1970 | Powers et al. | 117/217 |
| 3,661,783 | 5/1972 | Cooper | 117/47 R |

OTHER PUBLICATIONS

"Electroplating of Co & Co Alloys–A Review," by Morral, Plating, 6–67, pp. 693, 696.

"Modern Electroplating," by F. A. Lowenheinn, 1963, pp. 143–144.

*Primary Examiner*—R. L. Andrews

*Attorney, Agent, or Firm*—Weiser, Stapler & Spivak

[57] ABSTRACT

A thin, ferromagnetic layer which can be continuous, substantially pit-free and uniform, said layer having high bit density capabilities consisting essentially of cobalt in the form of close packed hexagonal crystals. A substrate is treated with a catalytic activator upon which is deposited an electroless conductive layer, such as copper; the cobalt layer is deposited by electroplating on the conductive layer. The ferromagnetic layer has a nominal coercivity of about 200 to about 500 oersteds and exhibits no anisotropy in the plane of deposition.

40 Claims, No Drawings

FERROMAGNETIC MEMORY LAYER, METHODS OF MAKING AND ADHERING IT TO SUBSTRATES, MAGNETIC TAPES, AND OTHER PRODUCTS

Heretofore, most commercially available magnetic memory layers comprised metal oxides dispersed in binder systems and coated onto suitable substrates. To a very limited extent metal alloy layers are also used. Known metal oxide magnetic memory layers possess the following undesirable characteristics:

1. Metal oxide particles are anisotropous and in order to improve switching times and frequency response it is necessary to orient the particles, and even with the best possible orientation the variation in coercivity among the particles results in wide bands of coercivities in the magnetized volume.

2. Metal oxides are very abrasive and cause severe wear of the tape path in the recorder. The debris from this wear accumulates on tapes and heads causing aberrations in the recording and the recovery of information.

3. Because of the irregularities in the surface of the plastic films used as substrates for metal oxide magnetic layers, large deviations in coating thicknesses are very difficult to eliminate. These variations in the thickness of the magnetic layer give rise to variations in output amplitude.

4. Coating thicknesses substantially below 100 microinches result in severe loss in signal amplitude.

5. The binder used to disperse the metal oxides gradually disintegrates causing undesirable fault counts.

Known current metal alloy magnetic memory layers possess the following disadvantages:

1. Alloys such as nickel-cobalt-phosphorous and cobalt-phosphorous alloys are used, and because the alloy is not uniform, differences in magnetic charateristics are found in the volume of magnetic material encompassed by a flux reversal. This leads to distortions in the output of the recorded layer.

2. Adhesion to the substrate is not satisfactory.

3. Imperfections, particularly pin holes, are formed in the layer.

4. There is no satisfactory overlay which will protect the metal alloy layer from damage and which is thin enough to prevent separation losses.

It is therefore a primary object of this invention to provide a thin ferromagnetic layer which overcomes the above-noted disadvantages of the metal oxide and metal alloy layers and to provide magnetic members, such as tapes, drums, discs and like shaped objects embodying the thin ferromagnetic layers. The magnetic members of the invention are useful in digital, video, instrumentation, audio recording and reproduction and numerous other applications in the field of storage and release retrieval, reproduction and the like of information, signs, sound, data and the like.

Another object of the invention is to provide a magnetic memory layer for magnetic recording purposes having uniform (as understood and defined further below) magnetic characteristics throughout the area and thickness of the layer, which characteristics can be pre-selected and reliably reproduced.

Another object is to produce a magnetic memory layer with a smooth surface approaching optical reflectivity which will be capable of maintaining intimate and close proximity with the transducers of the recording system.

Another object is to provide a magnetic memory layer which is very thin, in the order of magnitude of 0.05 to 0.5 microns in thickness, so as to increase the information density, frequency response and data rate capability of the layer without a reduction of output amplitude.

Another object of the invention is to provide a method of forming and adhering the ferromagnetic layer on suitable substrates without pits, variations in thickness and similar defects and to provide if desired and overlay on the magnetic layer which will protect the surface of the layer from corrosion and abrasion, also provide lubricity for the tape path in the recorder and interconvolution lubrication in the roll of tape.

A further object is to provide a thin, continuous substantially defect-free layer of cobalt of close packed hexagonal crystals electrodeposited on a conductive layer which is strippable from a support and subsequently securable by adhesion and similar means on a selected substrate.

Yet another object is to provide a method of making a thin ferromagnetic layer and adhering the same tenaceously to a rigid or flexible substrate with readily available materials and at reasonable production costs.

The foregoing objects are attained by providing in accordance with the invention a very thin ferromagnetic layer having the following characteristics:

1. The metal consists essentially of pure cobalt having a crystal structure which is close packed hexagonal as determined by x-ray diffraction.

2. The thickness of the layer is between about 0.05 to 0.5 microns and the layer is substantially continuous, uniform and pit-free.

3. The specific magnetic inductance is between about 6,000 and about 16,000 gauss, commonly 10,000 to 14,000, a practical value being about 12,000 gauss.

4. The layer has generally isotropic magnetic characteristics in the plane of deposition.

5. The layer has nominal coercivity of between about 200 and about 500 Oersteds.

6. The coercivity content deviates from that which is dominant by an amount which is controlled according to the requirement of the recording system with which the layer is to be used. Generally for digital recording the deviation is minimal, approaching zero in the extreme case, but more commonly lying between this minimum value and a maximum deviation of about 40%. For analog systems it appears desirable to introduce a coercivity deviation of between about 20% and about 100%.

7. The ratio of remanent induction to saturation inductance approaches unity in the extreme but more commonly will be greater than 0.8.

The products (and the methods) of the invention provide an important contribution to the art in numerous fields of application.

Magnetic layers exhibiting the above characteristics are superior to the state of the art layers for use in magnetic recording because, for digital use, higher bit densities can be achieved and higher data transfer rates can be employed. These results are obtainable because the thin layer greatly reduces flux spread around the magnetized area of the layer and the containment of the flux reversal within a short segment of the magnetizing field reduces the fringing of the magnetized area due to the magnetization of wide coercivity bandwidths of the layer. In amplitude discrimination recording systems the thinner layer represents the capability to accommodate shorter wavelengths, and therefore higher frequency response is to be expected.

The term "continuous" as used herein with respect to the magnetic layer means that substantially no separations exist which interfere with the recording and retrieval of information by the transducers. Thus microscopic physical separations do not detract from the effectiveness of the product of the invention, especially where the wave-length is substantially longer than the physical discontinuity. For instance, an imperfection such as a pin hole 20 microinches long will not interfere with a flux reversal occupying 200 microinches of tape length.

As used herein the term "substrate" means the base member upon which the conductive layer is electrolessly deposited and then the magnetic memory cobalt layer is electrodeposited. The layer is either rigid or flexible and capable of being made from a wide variety of materials natural materials, like metals, wood, or paper, synthetic mateials like synthetic polymers (homo- or copolymers) like olefins, dienes vinyl and vinylidene polymers, fluorocarbon polymers, polyamides, polyesters, polyethers, polyurethanes, polyacetals, polysulfides, polycarbonates, cellulosic polymers, like cellulose ethers, thermosetting polymers like epoxy, phenolic, amino and other. For instance polymers like polyesters, polyimides, cellulose acetate, acrylates form very suitable substrate materials. Mixtures of resins may be used.

The term "conductive layer" means the electrically conducting layer or film received by deposition, adhesion or other means on the substrate, which conductive layer may consist of metals such, for example, as copper, nickel, chromium, cobalt, the noble metals, lead, zinc or non-metallic electrically conductive layer like a film of carbon.

The term "activator" means the salts of the noble metals, such, for example, as palladium, silver, gold, and platinum or the salts of copper or nickel which when reduced to a lower valance form or the free metal or mixtures thereof form dense and uniformly distributed nuclei or sites which catalyze the electrodeposition and tenacious adherence of the conductive metal layer to the substrate.

Broadly, the method of the invention of forming the thin cobalt layer on a substrate comprises applying to a substrate a catalytic activator, depositing an electroless conductive coating thereon after, if necessary reducing the activator, and then electrodepositing the thin layer of cobalt on the conductive layer. This deposition is carried out from a cobalt plating bath maintained or having a pH within a specified controlled range in which the conductive coating of the substrate is the cathode and pure cobalt is the anode. Alternatively, an insoluble anode can be used and cobalt made up by addition of cobalt hydroxide or the like. Other anodes would also give a satisfactory deposit but the bath may become quickly contaminated. In accordance with the invention, the essential magnetic characteristics are accurately controlled because:

1. In electroplating, the thickness of the electrodeposition is primarily dependent on the plating current.

2. Preselected uniformity or predetermined nonuniformity of deposition is brought about by the use of a constant current power supply, maintenance of uniform motion of the cathodic surface of the substrate with respect to the cobalt anode and the plating solution and the use of shields and the like to eliminate edge effects.

3. The magnetic coercivity is controlled by the concentration of the cobalt ions in the plating solution.

4. The squareness of the hysterisis loop is increased by the use of constant current density and plating solution circulation to maintain a substantially constant chemical composition of the solution at the cathodic surface of the substrate.

The deposition of the cobalt on the conductive layer of the substrate is of primary importance and is effected by electroplating the cobalt from an aqueous plating solution of a soluble cobalt salt, such as cobalt chloride, the pH of the plating solution being maintained at at least 3.6, preferably between 3.6 and 5.8, and more specifically between 3.8 and 4.8. It is desirable not to exceed a pH of 5.8 to prevent codeposition of basic salts. In order to more closely maintain the plating parameters such as pH and cobaltous ion concentration at the cathode deposition surface as well as to maintain the chemical balance of the bath the solution is advantageously buffered to the desired pH level with organic compounds containing the carboxylic radical such as unsubstituted and/or substituted carboxylic acids preferably water-soluble, more particularly acetic diglycollic and malonic acids. It was also found that organic compounds containing hydroxy (mono-orlpoly-) radicals such as ethylene glycol and lower alkanols like ethyl alcohol are suitable to maintain constant solution parameters at the cathode surface. It was also found that substances such as glycols and glycerine contained in the cobalt plating bath permit the limited recrystallization of the cobalt layer subsequent to plating. The recrystalized material furthermore exhibited a lower coercivity and squarer hysterisis loop. Such substances also permit the use of higher plating currents which are especially advantageous when the cobalt is deposited on a web in motion. Cobaltous perchlorate may be used instead of the cobaltous chloride, but its use involved operational hazards. The useful salts are water-soluble.

In the electrodeposition of the cobalt, the conductive layer of the substrate is rendered cathodic and is passed through the cobalt plating solution using a soluble cobalt anode. It is very important, when the fullest advantages of the invention are to be obtained that the cobalt salts and cobalt anode by substantially pure. The degree of purity of the cobalt on the 100% metal basis should be such that the cobalt shall not contain the following elements in percentages significantly greater than Fe = about 0.003%, Ni = about 0.060%, Cu = about 0.001% and Mn = about 0.0005%. The Fe and Cu impurities have an adverse effect on the quality of the electroplated cobalt layer.

The coercivity of the magnetic layer is inversely proportional to the concentration of cobalt ion in the plating solution, low cobalt ion concentration producing high coercivity and vice versa. It was found that within the range of about 200 to 400 oersteds, and a range of cobalt chloride hexahydrate, $CoCl_2,.6H_2O$, concentration of 136 g/l to 400 g/l the coercivity is generally a linear function of the cobalt ion concentration. Thus if the cobalt ion concentration at the cathodic conductive layer of the substrate changes significantly, so will the coercivity of the plated cobalt and the cobalt layer will thereby exhibit an unsquare hysterisis loop. This is illustrated by the following test data:

TABLE I

| | | | | | |
|---|---|---|---|---|---|
| Coercivity, Oe. | 400 | 375 | 300 | 250 | 180 |
| $CoCl_2 . 6H_2O$, g/l | 136 | 183 | 240 | 315 | 400 |
| Amps/ft | 48 | 48 | 48 | 48 | 48 |
| Time, min. | 0.6 | 0.6 | 0.6 | 0.6 | 0.6 |

Therefore, the range of concentration of the cobalt salt in the aqueous plating solution should be about 13.0 to about 40.0% by weight, the preferred solution containing about 20%. A typical but non-limitative example of such a solution contains 135 g per liter cobalt chloride hexahydrate in water.

The cobalt layer is electrodeposited on the conductive layer of the substrate, which as mentioned hereinbefore can be rigid or flexible. Superior results with regard to adhesion of the conductive layer are obtained by pretreating the substrate with activators and reductants to provide catalytic nucleation sites for the electroless deposition of the metal of the conductive layer thereon, as will be described hereinafter. However, the electrodeposition of the cobalt on the conductive layer can also be attained without this catalytic pretreatment, particularly as applied to rigid metallic substrates; and it appears to be of greatest benefit for nonrigid or flexible or elastic substrates.

Additionally, it is possible to electrodeposit the cobalt on a conductive layer which is strippable from a support and then transferred and secured if desired, preferably by adhesion to a substrate.

The following are non-limitative examples of the deposition of the ferromagnetic cobalt layer on a rigid metallic disc and on a flexible resinous substrate to produce magnetic tapes and the like. The latter example is, of course, applicable also to the deposition of the cobalt layer on relatively rigid resinous substrates such as discs, drums and the like.

Deposition of Colbalt Layer on Rigid Substrate

A disc about 14.5" in diameter having a central mounting operative of about 6.1" in diameter and a thickness of about 0.06" made of aluminum or an alloy of aluminum containing 4.0% magnesium and 0.5% manganese is sanded and machined to insure concentricity. The disc is then annealed and surface finished with diamond tools to produce an overall flatness of 0.002–0.003 inch and a surface finish of 1.0–1.5 microninches, arithmetic average.

The disc is then cleaned, dipped in a 50% $HNO_3$ solution, rinsed with water and immersed in a zincate bath to provide a zinc coating, the bath including 120 g/l sodium hydroxide, 20 g/l zinc oxide, 50 g/l Rochelle salt, 2 g/l ferric chloride and 1 g/l sodium nitrate.

It is then immersed in a nickel plating bath adjusting to a pH of 4.0 to 6.3 to provide a smooth nonmagnetic electroless deposite of nickel on the zinc. The nickel plating bath contains 10 g/l basic nickel carbonate, 6 m/l 70% hydrofluoric acid, 5.5 g/l citric acid, 10 g/l ammonium acid fluoride, 20 g/l sodium hydrophosphite and ammonium hydroxide to adjust the pH 4.0–6.3, the bath being maintained at about 170–180° F. The nickel layer is activated by immersing the disc first in a 50% $H_2SO_4$ solution followed by cathodic alkaline cleaning then in a 1% $H_2SO_4$ solution and rinsing with water. Copper is then electroplated in a thickness of about 1 mil on the nickel.

The cobalt magnetic layer is then plated with the magnetic cobalt layer of the instant invention by making the disc cathodic by immersing it in aqueous plating bath containing 132 g/l $CoCl_2.6H_2O$ and buffered with acetic acid and cobalt hydroxide to a pH of 4.0–4.5, using a pure cobalt anode and plating for about six seconds at a current density of about 90, amp/ft$^2$ using filtered rectified A-C current. The electrodeposition is carried on at room temperature and the pH of 4.0 to 4.5 is maintained throughout. The geometry of the plating system is arranged so that all parts of the disc are plated at the same current density to obtain uniform coercivity and remnance. Since there is considerable difference between the top and bottom of a disc plated while stationary, the disc is rotated to eliminate this effect, with plastic shields to control the plating distribution from the anode, which may desirably be a ring of pure cobalt. The average thickness of the deposited cobalt on the disc is about 7 microinches.

A protective coating, approximately 4 to 35 microinches thick is then applied to the cobalt layer which may be composed of an epoxy resin pigmented with up to 10% of finely divided $Cr^{+3}$ oxide dissolved in a high boiling organic solvent. The disc is dipped in the coating, centrifuged to remove excess material and evenly distribute the coating, and dried in a dust-free atmosphere.

Deposition of Cobalt Layer on Resinous Substrate

The conventional film base of a tape substrate to receive the magnetic cobalt layer is generally made of a polyester resin although other resins, such as polyimide, cellulose acetate, methyl or other esters of acrylic or methacrylic acids, etc. can also be used. The nonmagnetic or back side of the tape may be coated with a conductive layer of a carbon-loaded plastic to eliminate static charge during computer operation. On the front or magnetic side of the tape, according to the invention, a layer of resin is adhered to the tape, which resin contains activating materials, which when reduced form catalytic nuclei for the electroless plating of metal to form the conductive layer and achieve improved surface smoothness. The conductive layer preferably of copper is chemically plated on the front or activated side of the tape to provide a retentive base for the electroplating of the extremely thin ferromagnetic cobalt layer having the aforementioned superior magnetic properties according to this invention. Finally, a protective coating of graphite or of a suitable plastic, like a fluorinated hydrocarbon resin may be placed over, and made to adhere to the magnetic cobalt layer to complete the magnetic side of the tape.

The magnetic tape is preferably fabricated in a continuous process which deposits the necessary layers in sequence. A roll of polyester base film approximately 0.0015 inch thick and having about 3500 linear feet is unwound according to conventional means and drawn through suitable apparatus where it is cleaned for foreign material as it is unwound in a manner which prepares the surface for the coatings which are next applied.

The clean film is then coated with a resin solution containing an activator in the form of a catalytic metal salt, then is subjected to the action of a reductant which reduces the catalytic metal ions to an insoluble catalytic substance which serves as nuclei or catalytic sites uniformly and densely distributed on the surface of and in the resin. The catalytic sites are subjected to an aqueous electroless plating solution of a conductive metal salt, such as a copper salt, whereupon the ions of the conductive metal are reduced at the sites and thereafter autocatalytically to their native metal, or at least to a lower valency forming a thin, uniform, continuous tenaceously adherent layer or film of conductive metal on and in the resin. Thereafter, the cobalt is electrodeposited on the conductive layer.

The conductive layer underlying the magnetic layer should contain no substances which by migration into the magnetic material would cause the magnetic properties to degrade. The conductive layer should contribute no magnetic properties which would interfere with the performance of the product, but it may conceivably possess magnetic properties which would contribute to the performance of the product.

In an example of the invention the resin solution used was a 5–15% solution of Saran F130, a copolymer of vinylidene chloride and acrylonitrile (Down Chemical Co.) in a high boiling solvent such as cyclohexanone diluted with a suitable solvent such as tetrahydrofuran, acetone, n-propylacetate, toluene, etc. and various mixtures thereof, containing dissolved therein a catalytic metal salt of the noble metals or copper, such as palladium chloride. In this example, 0.1 to 1.5% of the catalytic metal salt by weight of the dry resin was used, it being understood that this can be balanced with other factors such as the composition of a electroless conductive metal solution, its pH and temperature since these also effect the time for initial coating of the conductive metal on the film base.

Other high boiling solvents are useful too like methylisobutyl ketone, cyclohexanone, n-propyl acetate mixtures thereof and the like. Other salts of noble metals or of copper are likewise useful like platinum, palladium, silver, silver acetate, lithium tetrachloroaurate dihydrate, $LiAuCl_4.2H_2O$, cuprous chloride, etc.

The resin-catalytic salt or activator is coated on the clean film base by means, for instance, of a gravure type coater to provide a layer of resin preferably of about 0.000005 to 0.000150 inches thick.

As indicated hereinbefore the resin solution coated on the substrate may be copolymers of acrylonitrile such as copolymers of vinylidene chloride and acrylonitrile, copolymers of styrene and acrylonitrile, epoxy resins, methacrylate resins, phenolic-aldehyde, polyethers, polyamides, polyester resins containing cyano groups. A cyano-containing resin is very desirable or the cyanide ion may be incorporated by means of a suitable reactant to a resin solution or to the final resin.

In the electroless deposition of the conductive layer on the activated resin, the probable mechanism appears to be that as the catalytic metal ions are reduced to form nuclei, they initiate the reduction of the conductive metal ions to their metallic form; hence the conductive metal adheres tenaceously to the resin coating at the nuclei or sites which are not only on the surface but also in the body of the resin.

Since the electroless solution of the conductive metal salt in aqueous, it appears that it is highly desirable that the resin coating be such as to allow dispersion of the electroless solution therein. This is generally accomplished by the use of an organic solvent for the resin, which is less soluble in water than water is in the solvent, as for example cyclohexanone. Thus the resin coating is not completely dried to allow residual solvent to remain for the reception of the aqueous electroless solution.

It would appear that cyano-containing resins are superior for the purpose of the invention because the catalytic metal ion is complexed otherwise held thereto; therefore when the ions are reduced, catalytic nuclei or sites are formed chemically bound to the resin which are densely packed, evenly distributed in the resin coating and adherent to the resin for reception of the electroless metal, thus forming a tenaceously adhering continuous film or layer of conductive metal for subsequent receipt of the electroplated cobalt.

The process of the invention comprises a number of steps for the production of the magnetic memory member of the instant invention, which comprise:

Coating a resin solution containing the activator on the selected substrate;

electrolessly plating with an aqueous electroless solution of the conductive metal ions and a reductant, the conductive metal on the activated resin coating; and electrodepositing the layer of cobalt on the conductive layer.

Alternatively, the process may be carried out as follows:

coating a resin solution containing the activator on the selected substrate;

treating the activated resin with an aqueous solution of a reductant;

electroless plating with an aqueous electroless solution the conductive metal ions, the conductive metal on the activated reduced resin coating; and electrodepositing the layer of cobalt on the conductive layer.

Alternatively, the process may be carried out by:

coating a solution of the resin and reductant on the substrate;

treating the substrate with an aqueous solution of the activator or catalytic metal salt;

electroless plating with an aqueous electroless solution of the conductive metal ions the conductive metal on the activated reduced resin coating; and electrodepositing the layer of cobalt on the conductive layer.

Typical reductants which can be employed to reduce the noble metals, or the copper ions to the catalytic form may be stannous chloride, hypophosphites, amine boranes, alkali metal borohydrides and the like.

The preferred sequence of steps is the first above-described. Where the electroless metal is copper, it is preferably that only silver and gold salts be used to create the catalytic nuclei. Where the electroless metal is nickel, it is preferable that palladium and platinum only be used but then it is highly desirable to use a reductant which is an aqueous solution of sodium hyposphite and dimethylamine borane. In the second procedure described, palladium, platinum, silver and copper are most advantageous as the catalytic metal with the above reductant. In the third procedure, palladium, platinum and gold are the preferred catalytic metals and all reductants set forth above can be used.

Non-limitative examples of the resin-activator compositions and reductant solutions employed on the above methods and products of the invention obtained are as follows:

EXAMPLE 1

A solution of 0.10 g palladous chloride, 0.09 g hydrochloric acid (36%) and 5ml of water is added, after boiling and cooling, to 50 ml acetone and this catalyst solution is then added to a resin solution comprised of 20% by weight of Saran F130 (Dow Chemical Co.) in a solvent consisting of 10% cyclohexanone and 90% acetone by volume.

EXAMPLE 2

0.10 g palladous chloride and 0.05 hydrofluoric acid (52%) are dissolved in 10 ml water with the aid of a few drops of hydrogen peroxide solution (30%) and, after boiling and cooling, is added to 50 ml acetone. The catalyst solution is then added to the same resin solution of Saran F130 as set forth in Example 1.

EXAMPLE 3

0.1 g palladous acetate, is dissolved in 20ml of n-propyl acetate and then added to a solution of 15 g Saran F130 in 1500 ml n-propyl acetate.

EXAMPLE 4

0.10 g palladous chloride is dissolved in 20 ml water to which 0.5 acetic acid was added. The solution is evaporated to 5 ml and diluted with a mixture of 90% acetone and 10% cyclohexanone by volume. Twenty-five ml of this catalyst solution is added to a solution of 10 g Saran F130 in 10 ml cyclohexanone and 40 ml acetone.

Examples 1–4 yield resin solutions which are useful to coat articles and are receptive to electroless plating by the first and second methods described above to give metalized products such as mirrors, infrared insulators, capacitor stock, copper clad dielectrics, and conductive coating for subsequent electroplating to form magnetic memory layers, duplex metal printing plates. When the coatings are applied selectively the metal deposits will form articles useful as printed circuits, printed wiring and the like.

EXAMPLE 5

2 g silver nitrate are dissolved in 3 g dimethylformamide and added to a solution of 30 g Saran (f-130) in 1 liter of cyclohexanone.

EXAMPLE 6

0.2 g silver nitrate is dissolved in 0.3 g dimethylformamide and added to a solution of 100 ml cyclohexanone containing 3 g Saran F130.

Examples 5, 6, yield coatings which when immersed into an electroless copper such as that described in Example 21 in accordance with the first described procedure copper layer useful for printed circuits and for electro plating of a magnetic layer, chromium layers for printing plates, copper for etching stock, etc.

EXAMPLE 7

4.8 g palladous chloride are dissolved in 6.0 g hydrochloric acid (36%) and 100 g water 400 ml dimethylformamide, 900 ml methyl ketone, 1200 ml methyl isobutyl ketone and 300 ml Saran F130 previously dissolved, 15% by weight in a solvent consisting of 25% methyl ethyl ketone and 75% methyl isobutyl ketone by volume.

Coatings prepared using this resin solution are rendered receptive to electroless plating by a reductant comprised of dimethylamineborane and sodium hypophosphite to prepare the article for copper plating by the second described procedure.

The following examples are illustrative of the alternative procedure in which the activator or reductant is added to the resin solution, coated on a film base, dried and then immersed in or coated with the catalytic solution.

EXAMPLE 8

A resin solution is prepared by dissolving 20 g Saran F130 in a mixture of 10 ml cyclohexanone and 80 ml methyl isobutyl ketone to which is added 2 g stannous chloride dissolved in 2 ml dimethylformamide. The film base is coated with this resin solution and dried and then immersed in or coated with an aqueous catalytic salt solution of 0.5 g/l of palladous chloride-sodium chloride whose pH is adjusted to about 2.0 with hydrochloric acid at 70°–80° C.

EXAMPLE 9

1.5 g sodium borohydride are dissolved in 150 ml dimethylformamide and 1200 ml n-propyl acetate is added. 150 g Saran F-130 are dissolved therein. The film base is coated with this resin solution, dried and immersed or coated with the aqueous catalytic salt solution used in Example 8.

Examples 8 and 9 produced adherent catalytic sites on the substrate for plating nickel, copper, cobalt, palladium, etc. from conventional electroless solutions to yield thin adherent metal or alloy plates.

EXAMPLE 10

An activated resin solution is prepared by dissolving 2.5 g sodium borohydride in 250 ml dimethylformamide. This is added to a resin solution comprised of 180 g Saran F130 and 1800 ml tetrahydrofuran.

The polyester film is coated with this resin solution, dried and then immersed into a catalyst solution containing 0.5 g silver acetate, 10 ml acetic acid 50 ml 2-propanol and water to make up one liter.

EXAMPLE 11

An activated resin solution is prepared by dissolving 1 g dimethylamineborane in 1500 ml N-propyl acetate and then adding 50 g Saran F130 to solution and then diluting with 500 ml methyl isobutyl ketone.

The resin solution is coated onto a polyester web, dried and immersed into a catalyst solution comprised of 1 g palladous chloride 300 ml hydrochloric acid (36%), 10 l water and 500 ml acetone. The temperature of the catalyst is maintained at about 50° C and the duration of the treatment is about 20 seconds.

EXAMPLE 12

A resin solution is prepared by dissolving 360 g Saran F-130 and 4 g trimethylamineborane in a solvent mixture comprising 3000 ml dioxolane and 900 ml dioxane:

A sample of polyester web is coated with this resin solution, dried and introduced into a catalytic salt solution containing 5 gallons water, 1 liter methyl ethyl ketone and 5 g palladous hydroxide previously dissolved into 100 ml aqua regia, wherein pH is adjusted to 1.5 with aqua regia and then rinsed with water.

Examples 10, 11 and 12 are useful in providing catalytic sites for electroless plating of copper, nickel, cobalt, etc. and to produce a thin, electrically conductive layer receptive to electroplating.

EXAMPLE 13

An activator or reductant solution is prepared by dissolving 10 grams anhydrous stannous chloride in 10 ml dimethylformamide.

A resin solution is prepared by dissolving 9 g Saran F130 in a solvent mixture containing 10 ml of cyclohexanone and 45 ml acetone and 45 ml toluene.

A catalyst solution is prepared by dissolving 0.2 g palladous chloride in a little hydrochloric acid, adding water to 1 liter and adjusting the pH to about 3.5 with hydrochloric acid. The temperature is raised to 75 C.

An electroless nickel plating solution is prepared by dissolving 12 g nickel carbonate in 250 ml water to which 25 ml propionic acid has been added. After solution at elevated temperature 36 g trisodium citrate dihydrate, 18 ml strong ammonia and water to 1 liter are added and the pH adjusted to about 6 with propionic acid. Before use 20 g sodium hypophosphite mono-hydrate is added and thereupon the temperature is raised to 75 C.

The resulting mixture is roller coated onto polyester film employing a 65 Q engraved roll, the coating is air dried and the coated film is immersed into the catalyst solution at 75° C for five fifteen seconds, rinsed in tap water and thereupon immersed into the nickel plating solution at 75° C, whereupon nickel plates onto the catalytic layer.

There is produced a uniform nickel plate which is suitable as a continuous, defect-free and non-contaminating catalytic surface for the electroless deposition of copper. This yields a plate with an extremely uniform layer of copper in order, for instance, to insure extreme uniformity of current distribution in a subsequent electro plate.

The amount of activator solution added to the resin solution can be varied between wide limits, but it was found that utilizing the above formulations, a minimum of activator to achieve uniform and complete nickel coverage is preferably about 1.0 g per 100 ml of resin solution in order to promote formation of a nickel plate free of pin holes and uniformly coated. Greater amounts of the activator can be used, but this appears not as desirable.

When the above dried coated articles are immersed into the catalyst solution a fogging of the activated resin is apparent, presumably due to the absorption of water. It may thus be preferred to dry the coating of this water. In such a case it is thought that more nickel plating solution is absorbed into the layer, thus promoting the electroless plating from within the layer whereby adhesion is improved.

It should be mentioned that other concentrations of catalyst solution may be employed, but the range stated above is entirely adequate and economical. Also, other nickel plating solutions may be employed so long as they do not contain complexing agents which will promote the dissolution of the catalyst, thereby causing defects in the nickel plate and promoting the accumulation of catalytic debris in the nickel plating solution which may lead to decomposition thereof.

EXAMPLE 14

A mixture of 1.5 g palladous chloride, 7.5 g phosphoric acid and 50 ml are brought to a boil and the volume reduced to 25 ml by evaporation. When cooled to room temperature 200 ml tetrahydrofuran are added. 5 ml of the catalyst solution are diluted to 100 ml with 2-propanol and the resulting solution is gravure roll coated onto Kronar film (DuPont vinylidene chloride coated polyester). After drying, the coated film is immersed in an electroless nickel plating solution comprised of 0.1 N nickel sulfate, 0.1 N dimethylamineborane complexed with 0.1 N sodium hypophosphite in water operated at a temperature of about 65° C.

This example shows a useful application of a precoated substrate wherein it is not necessary to employ a resin.

It should be noted that so long as the coating is adherent to the substrate, the latter may be almost any substance.

EXAMPLE 15

An activator or reductant solution is prepared by dissolving 10 g anhydrous stannous chloride into 10 ml dimethylformamide. 0.10 g of this activator solution is diluted wth 20 ml 1,4 dioxane and two drops cyclohexanone and the diluted activator is coated with a 140 Q gravure roll onto a carbon pigmented Saran layer on polyester film. The carbon pigmented layer was made as follows by loading a one gallon stainless steel cannister with 8 lb nickel shot, 100 g carbon (Columbian Carbon Peerless 155 beads), 500 ml dimethylformamide and 15 g aluminum resinate (Meyers). The cannister is agitated for two hours. The dispersed carbon is loaded with resin by adding to the cannister during agitation, the resin comprising 200 g Saran F130, 800 ml methylethylketone, 350 ml cyclohexanone and 350 ml ethyl acetate.

This coating is applied to the polyester web by means of a 45 Q gravure roll, and it was found that addition of 30% by volume dimethylformamide to the solution improved rheology. The diluted solution is dried and the resultant coating is smooth with a good degree of gloss and is almost opaque.

The activator solution is dried and then immersed in a catalyst solution containing 0.2 per liter palladous chloride with the pH adjusted to about 4 with hydrochloric acid and maintained at a temperature of about 70 C. for about 10 seconds. The sample is rinsed and is receptive to the electroless plating of metal thereafter.

This example produces a metal layer which is not visible from the reverse side and which is useful where photo electric sensors are employed to detect reflective markers on that side, as in computer tape.

It is possible to substitute for the nickel electroless bath, other electroless baths, such as, for instance, cobalt or palladium and plate these metals onto the catalytic surface when desired.

EXAMPLE 16

A polyester web is coated with Saran F130, 10% in a solvent comprised of 10% cyclohexanone and 90% acetone using a 45 Quad gravure coating roll. The coating is dried in 100° C for one minute and the web is rewound. The web is later unwound and coated with a solution of 1 gram trimethylamine borane, 2 ml ethyl acetate, 100 ml isopropyl alcohol using a 140 Quad gravure coating roll. The film is dried of solvents with room temperature air and the web is passed through a solution at room temperature containing, on a one liter basis, 50 ml methyl ethyl ketone, 1 gram palladous nitrate and 5 ml acetic acid for an immersion time of 30 seconds. The web is rinsed in water and then plated with copper from an electroless solution at a temperature of 55° C, a pH of 12.5. A plating time of 30 seconds gives a copper deposition with a conductivity of under 0.2 ohms per square.

The electroless solution is prepared as follows: 7.7 copper carbonate are reacted with 9.75 ethylenediamine tetraacetic acid in 250 ml water and 25.4 grams tetra sodium salt of ethylenediamine tetraacetic acid, 100 ml formaldehyde and water are to make up 1 liter with the pH adjusted to 12.5 with 20% sodium hydroxide, aqueous solution.

The web is rinsed in water, preferably acidified with hydrochloric acid to a pH of 3.5 to 4.5. Thereafter, the web is dried and either rewound or further processed depending on the product being produced.

This example shows a useful process wherein the coating may be applied to the film on equipment other than that employed in the metalizing process.

EXAMPLE 17

8.2 g copper carbonate and 7.5 g formic acid (90%) are reacted in warm water, 29.4 g of tetrasodium ethylenediamine teraacetate and water are added to make up 1 liter and the pH is adjusted to 12.5 with sodium hydroxide. The solution is heated to 60°–65° C and 20 ml of 37% formaldehyde, 25 ml 2-propanol and a wetting agent are added. This bath is agitated to provide air in the bath. This bath is capable of chemically plating a nearly opaque conductive copper layer on the moving film in 30 to 60 seconds for a period of about 45 minutes. The addition of more formaldehyde and sodium hydroxide allows the bath to be used for a longer period of time while the addition of more copper formate solution serves to replace the copper that is plated out. A copper film thickness of less that 5 millionths of an inch has been found to be satisfactory for the reception of a subsequently electroplated layer.

EXAMPLE 18

3000 ml of copper formate aqueous solution (15 g/l copper), 500 ml formic acid (90%) and 2000 ml of 39% tetrasodium ethylenediamine tetraacetic acid are mixed in 7 gallons of water. The pH is raised to 12 with sodium hydroxide, 175 ml of ½% phsophate wetting agent, 7000 ml of 2-propanol and 250 ml ammonia are added and the solution made up to 15 gallons. 3 liters of formaldehyde are added and the temperature raised to 65° C.

The copper plate, which is obtained in 30 to 60 seconds with either of the two aforementioned baths, is sufficiently conductive to act as a base for the subsequent electrodeposit of cobalt at medium current densities. However, a second layer of copper can be electrodeposited as an optional step on top of the chemically deposited layer, prior to the deposition of the cobalt layer. This will increase the conductivity and allow for use of higher current densities during the cobalt deposition. A bright acid copper bath such as a sulfate or fluoborate bath has been found to be suitable for the deposit of this second copper layer.

Preparatory to depositing the cobalt layer, it is highly desirable that the copper layer be rinsed and dried of surface liquids. A final rinse in alcohol which eliminates water droplets and evaporates rapidly has been found to prevent local dilution of the cobalt solution which is next applied.

Nickel may also be chemically plated on the catalytic nuclei on the polyester film from the electroless solutions. An illustrative example of such a nickel solution will be found below.

EXAMPLE 19

12 g nickelous carbonate is reacted with sulfuric acid in 900 ml water to give a solution pH of 5.8.

100 ml of a reductant solution is added comprising, on a 1 liter basis, 35 g dimethylamine borane, 76 g sodium hypophosphite monohydrate and water.

The electroless nickel plating solution is operated at between about 50° C and about 65° C.

EXAMPLE 20

A catalyst solution is prepared by dissolving 0.22 g silver nitrate in 10 ml pyridine. To 7 ml of this catalyst solution is added 37 ml cyclohexanone and coated onto polyester film with a 65 Q engraved roll.

The dried film is immersed into a copper plating solution operated at about 65° C and made up to 1 liter as follows:

4 g cupric carbonate reacted with 4.4 ml formic acid (90%) in 600 ml water, 20 g ethylenediamine tetraacetic acid is added and the pH adjusted to 13 with sodium hydroxide and the volume adjusted to 1 liter 1.4 g hydrofluoric acid (52%) is added and 6.8 g sodium sulfite and 25 ml formaldehyde. There is produced a copper coated polyester when it is not necessary to improve the substrate finish with a resin coating.

EXAMPLE 21

A stable copper plating solution is prepared as follows:

7 g cupric carbonate, 28.6 g ethylenediamine tetraacetic acid and 21.5 g sodium hydroxide are reacted in 500 ml water without heat.

There is added 2.4 g hydrofluoric acid (52%), 1.3 g phosphorous acid, 0.26 g potassium cyanide, 160 ml 2-propanol, 24 ml formaldehyde (36%) and water to 1 liter. When ready for use the pH is adjusted to 12.0 with 20% aqueous sodium hydroxide and the temperature is brought to 50–70 C. This formation is preferably diluted to 2 l for use with silver containing catalystic coatings when employing the first described procedure.

It is noteworthy that the copper plating solutions of the invention can be characterized as being stable which means that they can be operated essentially continuously without spontaneous decomposition, except in cases where they are contaminated by catalytic debris which should not occur in accordance with the invention.

EXAMPLE 22

A reductant solution is made by dissolving 5 g trimethylamineborane in 25 ml dioxolane, and a resin solution is made comprising 10% Saran F-130 in n-propyl acetate. 5 drops of the reductant solution were mixed with 25 ml of the resin solution and the resultant mixture was roller coated onto " thick Plexiglas sheet. The dried sheet was immersed in a catalyst solution prepared in accordance with Example 2, rinsed in water and plated with nickel employing the electroless plating solution prepared according to Example 16.

There is produced a highly reflective nickel layer suitable for unbreakable mirrors.

EXAMPLE 23

A preferred reductant, B-4280A, for use with palladous salts contained in resinous coatings is prepared by dissolving 35 g dimethylamine borane and 76 g sodium hypoposphite monohydrate in 1 liter of water. To reduce palladous ions in resin coatings B 4280 is diluted to 5 liter and 16 ml per liter n-propanol are added. The reductant solution is preferably operated at elevated temperatures, 30° C–70° C.

As a reductant in nickel plating it is employed at from 25 – 100 ml per liter of plating solution which contains soluble nickel salt at a concentration of about 0.01N to 0.1N without a complexing agent.

The hypophospite ions may be introduced in compounds other than that with sodium, like potassium.

EXAMPLE 24

To 5 ml cyclohexanone and 45 ml n-propyl acetate 5 g Saran F130, 0.05 g trimethylamine borane and 0.10 g Aerosol O.T. are added.

This resin is roller coated onto polyester film and immersed into an aqueous solution of silver fluoride, rinsed and nickel is plated onto it from an aqueous solution comprised of 0.1 N nickelous sulfate and 0.1 N B4280A, said solution maintained at a temperature of between about 50° C and about 70° C.

EXAMPLE 25

0.1 g silver acetate is complexed with 0.1 g pyridine, dissolved in 10 ml cydohexanone and 20 ml methylethylketone, and 10 ml of an epoxy resin solution obtained from Riegal Paper Co. and designated 200–17–B.

This resin is coated onto polyester film dried and immersed into a copper plating solution prepared according to Example 23 to which 1-propanol is added, whereupon copper plates onto the activated resin.

EXAMPLE 26

0.1 g silver nitrate is complexed with 0.1 g pyridine and added to a resin solution containing 30 ml methylethylketone, 10 ml cyclohexanone and 25 ml of a phenolic butyral resin solution contained from Riegel Paper Co. and designated 242–31–1.

This resin is activated immediately prior to use and coated onto polyimide or polyester film and plated with copper according to Example 23, diluted to 0.5 g copper content.

When plated on polyimide (du Pont Kapton) this structure may be cured at 300° – 350° F for 30 minutes and used for printed circuits where the materials will withstand soidering temperatures.

EXAMPLE 27

0.025 g lithium gold chloride dihydrate is dissolved in 30 ml methylethylketone, 10 ml cyclohexanone and 20 ml phenolic butyral resin solution, 25% solids, (Riegel 242–31–1).

Coated onto du Pont Kapton and dried, copper plates thereon from an electroless copper solution prepared according to Example 23. After curing at 300° F for 30 minutes the copper and coating remain adherent. Subsequent to curing additional copper may be deposited to give a heavy copper layer useful in the manufacture of flexible printed circuits.

EXAMPLE 28

Plexiglas (a polymer of methyl methacrylate) sheet is dissolved into a mixed solvent containing acetone cyclohexanone, toluene and n-propyl acetate to which palladous acetate is added as an activator. There is added potassium cyanide to saturation. When applied to a Plexiglas sheet, there is obtained a coated sheet to which nickel adheres firmly when plated according to the formulation of example 19. The nickel coated sheet can be heated and formed without distortion.

The product is useful in numerous applications like unbreakable heat reflective windows, skylights and the like. This metallized coating may be further coated with a Plexiglas resin solution, as above, to provide corrosion protection.

EXAMPLE 29

10 g styrene acrylontrile (Dow Tyril No. 880) are dissolved in 200 ml n-propyl acetate.

25 ml of this resin solution is added to 0.025 g palladous acetate with 5 g trichloroethane and about 5 ml dimethylformamide and a small amount of Plexiglas G, (Rohm & Hass, Polymethacrylate sheet) in trichloroethane.

When this activated coated is applied to the Plexiglas sheet, dried and plated, it can be heated to 300° F (thermoforming temperature) without cracking or crazing. This is desirable for making formed products such as heat reflective skylights and geodesic domes.

EXAMPLE 30

Adherent nickel is plated onto Plexiglas, Rohm & Hass polymethacrylated sheet) by first immersing Plexiglas sheet into a dilute warm solution of palladous acetate complexed with hydrofluoric acid, then rinsing and immersing into a nickel plating solution prepared according to example 19 and a small amount of alkyl aryl sulfonate wetting agent (Allied 35 SL). This produces a nickel layer which can be rendered corrosion proof by a coating of, for instance, acrylonitile styrene solution in n-propyl acetate.

The method of the invention can be carried out with conventional apparatus and comprises, essentially, unwinding the web of polyester film, applying the activated resinous coating solution thereto by means, for instance, of an ingraved coating roll, drying the coating, passing the coating web through a zone in which the coating is catalyzed, rinsing the web with water, depositing electroless copper on the catalytic coating, rinsing and drying the web, electroplating the ferromagnetic layer of cobalt onto the copper, rinsing, drying and rewinding. This is a substantially pure thin layer (0.05 to 0.25 micron) of cobalt comprised essentially of close packed hexagonal crystals, which layer is continuous, substantially pit and defect-free and comprises the magnetic memory medium. This result is accomplished by first depositing electroless copper as a conductive substrate on the base film of polyester by the afore-disclosed resin-activator-catalyst treatment which causes the copper to adhere tenaciously to the film in a thickness having a conductivity of about 0.5 to 0.2 ohms.

Inasmuch as it is important objective of the invention to produce a magnetic memory layer which will exhibit improved high frequency response, improved information resolution and higher information storage density, these characteristics, especially as compared to the prior art are set forth hereunder.

With respect to the recording of information it is important to consider the thickness of the magnetic layers. Because the magnetic field produced by the recording head decreases in intensity with increasing distance from the head it is shown that when the magnetic memory layer is homogeneous in coercivity throughout its thickness there will be a relative displacement in the location of equally magnetized portions of the layer when it is in motion in the presence of the recording fields which are varying in intensity according to the recording mechanism. This displacement leads to the spreading out of the flux reversal along the length of the layer so that in the reproduction of the flux reversal there is a loss of resolution and amplitude. The present invention utilizing a magnetic layer whose volumetric magnetic energy content is in excess of ten times that of commercially available coatings, permits the thickness of the layer to be reduced to less than one tenth of those presently in use, thereby substantially reducing these adverse effects.

Furthermore, the coercivity content of commercially available magnetic layers is widely divergent from that which is dominant. In the case of metal oxide containing coatings, magnetization (and demagnetization) commences with the imposition of the lowermost values of the recording flux reversal and continues until saturation field intensities are reached, intensities well in excess of the nominal coercivities. With the time and distance relationships introduced by the flux reversal frequency and the speed of the magnetic layer it is evident that the resulting recorded flux reversal occupies a long segment which presents a long transition time to the read head with a resulting low rate of change of flux. This low rate of change of flux produces low read signals which makes the signal to noise ratios low. The broad coercivity content makes the magnetic layer susceptible to partial demagnetization and print through, and these phenomena operate to increase noise levels. In the case of layers containing particulate matter dispersed in a binder system the variation in coercivity content is believed to arise from the anisotropous nature of the imperfectly oriented paticles and slight differences between them. In the case of metal alloy layers it is thought that it is caused by imperfect alloying and differences in deposition conditions, as well as anistropy in certain cases. In the case of the instant invention it has been shown that the coercivity of the material is closely controlled so that it is possible to deposit a magnetic layer whose coercivity content lies within prescribed limits. Thus, for instance, in the case of the digital computer it is possible to provide a magnetic layer whose transition from fully magnetized in one direction to fully magnetized in the other direction is accomplished in a magnetizing field increment of 20% or less of the nominal coercivity of the layer when examined in a conventional 60 cycle per second B-H meter. The extremely fast switching provided by this layer enhances its ability to resolve information at significantly higher transfer rates and packing densities. The absence of low coercivity components in the layer make less susceptable to stray fields which are the cause of noise and demagnetization.

It is also possible to vary the coercivity content within the depth of the layer so as to present lower coercivities to the weaker magnetizing fields found at the more remote distances from the recording head so as to insure even more uniform magnetization and resolution within the depth of the layer. Thus, the coercivity content within the depth of the layer is not uniform. It is to be noted that this is a distinguishing aspect of the layer of the tape or disc of the invention over metal or metal oxide products of the prior art. This is achieved by permitting a slight depletion of cobalt ions at the cathode surface whereby successively higher coercivities are obtained as the layer grows in thickness from the substrate.

To determine the uniformity of the inventive magnetic tape a statistical method may be employed as follows. A roll of computer tape 2400 feet long, ½ inch wide is unwound and at specified intervals, or at random, samples ¼" wide and 6" long are cut from the tape. These samples are inserted into or affixed to suitable carriers for insertion into a standard B-H meter such as, for example, a Model 651B B-H meter available from Scientific Atlanta, Inc. The hysteresis loops of the magnetic samples are cyclically traced at 60 cycles per second on the cathode ray tube of an oscilloscope and a direct comparison of the samples taken from the roll of tape will show essentially identical magnetic characteristics throughout its length.

In the reproduction of recorded information the amplitude of the reproduced signal is proportional to the rate of change of flux induced into the core of the head by the magnetized portions of the magnetic layer in close proximity thereto. Under the condition of identical time constants different thicknesses of magnetic coatings will be required to give equal amplitudes of reproduced signals depending on the extent to which each material contains magnetic energy. Since the cobalt layer described herein contains about 12 times as much magnetic energy as a gamma iron oxide layer of equal thickness a first approximation is that to duplicate a 100 microinch thick iron oxide layer will require about 8.5 microinches of the cobalt. However, it is necessary to consider losses in reproduction signal amplitudes which are caused by the coating thickness before determining the final equivalent coating thickness. The loss is expressed, in decibels, by the following relationship:

$$L_c = 20 \log_{10} \left[ \frac{2\pi c/\lambda}{1 - \exp(-2\pi c/\lambda)} \right] \cdot \quad (4.20)$$

In this formula C represents the thickness of the magnetic layer and λ the recorded wave length. Since the present lower limit of head gap lengths may be assumed to be about 40 microinches and this sets a minimum wave length (λ) of 80 microinches, it is possible to relate the losses of a thin magnetic layer to this wave length. In the case an iron oxide (typical of the prior art) the thinnest layer presently available is about 100 microinches which would give a ratio of c/λ of 1.25 and the above formula yields a loss due to coating thickness of about 17 DB. In the case of the instant invention a layer of 8.5 microinches in thickness gives a ratio of c/λ of 0.11 and a loss of about 2.5 DB. In practice it is found that the reduction of this loss permits the utilization of a cobalt layer of about 5 microinches in thickness in the product of the invention to duplicate the performance of a 100 microinch thick iron oxide layer typical of the prior art.

What is claimed is:

1. A magnetic memory member comprising;

a. a substrate;

b. a flexible synthetic polymer layer superimposed on a surface thereof, said layer having cyano groups, having a solvent-dispersed phase of catalytic nuclei of platinum, palladium, copper, silver or gold on its surface and concurrently therewith dispersed in the body of the resin;

c. a conductive layer of copper or nickel adhering to said nuclei; and d. a magnetic layer integrally secured to said conductive layer;

said magnetic layer consisting essentially of substantially pure closely packed hexagonal cobalt which is thin, uniform, continuous and substantially pit-free, having a thickness of about 0.05 to 0.5 microns and a smooth surface approximating optical reflectivity; a nominal coercivity of about 200 to about 500 Oersteds; an inductance of about 6,000 to 16,000 Gauss and a ratio of remnant to saturation induction greater than 0.8 and approaching unity at the extreme, the magnetic memory member having improved information density, frequency response and data rate capability without reduction of output amplitude.

2. The magnetic memory member of claim 1 wherein the substrate is conductive.

3. The magnetic member of claim 2 wherein the polymer is one of the following: acrylonitrile, styrene, epoxy, methacrylate, phenolic, polyether, polyamide, polyester free of cyano-groups.

4. The member of claim 3 wherein the flexible synthetic polymer is a tape.

5. The product of claim 4 in which the product is a plastic sheet.

6. The member of claim 3 wherein the flexible synthetic polymer is a polyester, a polyamide, polyimide, polyacrylic or a polymetharylic acid ester.

7. The magnetic memory member of claim 1 wherein the substrate is a flexible synthetic polymer.

8. The magnetic memory member of claim 7 wherein the flexible synthetic polymer has a layer adhering thereto which is of a synthetic polymer containing a cyano-group, said coating having incorporated therein catalytic nuclei of a noble metal selected from platinum, palladium, silver or gold which are receptive to the electroless deposition of copper.

9. The member of claim 1 wherein the conductive layer is copper.

10. The member of claim 9 wherein said substrate is rigid.

11. The member of claim 9 wherein said substrate is a flexible tape of a polymeric synthetic resin.

12. The member of claim 1 wherein the conductive layer is nickel.

13. The member of claim 1 wherein said tape is a polyester film.

14. The member of claim 1 wherein said conductive layer of copper is secured upon one surface of said tape and partially in the body of said tape beneath said one surface.

15. The product of claim 2 in which the noble metal is platinum, palladium, gold or silver.

16. The magnetic layer of claim 1 wherein the layer has graduated coercivity throughout the layer, varying between two limits of coercivities.

17. The magnetic memory member of claim 1 wherein in the flexible synthetic polymer of catalytic nuclei is platinum.

18. The magnetic memory member of claim 1 wherein in the flexible synthetic polymer the catalytic nuclei is palladium.

19. The magnetic memory member of claim 1 wherein in the flexible synthetic polymer the catalytic nuclei is copper.

20. The magnetic memory member of claim 1 wherein in the flexible synthetic polymer the catalytic nuclei is silver.

21. The magnetic memory member of claim 1 wherein in the flexible synthetic polymer the catalytic nuclei is gold.

22. A method of making a magnetic memory member by depositing a conductive layer coating on a substrate, making said conductive layer coating cathodic and electrodepositing a magnetic metal thereon, the improvement comprising:

a. applying to said substrate as a coating a solution of synthetic polymer containing a cyano group, the solution having one solvent therefore which is a high boiling solvent which is less solvent in water than water is in the solvent, the resin solution containing dissolved therein a platinum, palladium, copper or silver salt;

b. drying the coating until there remains a limited residual amount of the solvent;

c. applying to the coated substrate a solution containing a reductant which is absorbed by the coating to reduce the platinum, palladium, copper or silver ions substantially to their metal form, thereby creating catalytic nuclei in and on the coating surface;

d. applying an electroless solution of copper or nickel ions to chemically plate the copper or nickel in a substantially continuous layer, which tenaciously adheres to the coated substrate at the catalytic nuclei sites, the limited residual amount of solvent being an adequate amount to absorb the reductant; and e. electrodepositing thereon a layer of substantially pure closely packed hexagonal cobalt which is thin, continuous, uniform and substantially pit-free from an ageous plating solution containing the cobalt, said layer having a thickness of about 0.05 to 0.5 microns; a smooth surface approximating optical reflectivity; a nominal coercivity of about 200 to 500 Oersteds; an inductance of about 6,000 to 16,000 Gauss and a ratio of remnant induction to saturation induction greater than 0.8 and approaching unity at the extreme, thereby forming a magnetic memory member having improved information density, frequency response and data rate capability without reduction of output amplitude.

23. The method of claim 22 wherein the aqueous plating solution has a pH of at least 3.6, contains a soluble cobalt compound providing $Co^{+2}$ ions and uses a substantially pure soluble cobalt anode.

24. The method of claim 23 wherein the plating bath is buffered with a water soluble organic compound having a carboxylic or hydroxyl radical to a pH of about 3.6 to about 5.8.

25. The method of claim 23 wherein the cobalt plating is effected using a high current density and for a time sufficient to produce a cobalt layer of about 0.05 to 0.5 microns, whereby said cobalt layer has a nominal coercivity of about 200 to about 500 Oersteds.

26. The method of claim 23 wherein said substrate is a flexible resinous tape and said cobalt plating is effected by moving said tape continuously through the plating bath using a plating current of at least 1/3 ampere per inch of web width per foot per minute web speed.

27. The method of claim 17 wherein a filtered rectified AC current is used to effect the cobalt plating.

28. The method of claim 22 wherein said cobalt is a chlorate or chloride salt thereof.

29. The method of claim 28 wherein said cobalt compound is cobalt chlorate, cobalt perchlorate or cobalt chloride.

30. The method of claim 29 wherein the flexible synthetic polymer is a tape.

31. The method of claim 30 wherein the polymer is a polyester resin, and the resin solution comprises a copolymer of acrylonitrile.

32. The method of claim 30 wherein the polymer is a polyester resin, and the resin solution comprises a vinylidene chloride-acrylonitrile copolymer, and palladium acetate or silver nitrate.

33. The method of claim 30 wherein the electroless solution is an aqueous stable solution of cupric ions.

34. The process of claim 22 wherein the resin solution contains one of the following: cyclohexanone, acetone propylacetate, methyl ethyl ketone, tetrahydrofuran, dioxolane, dioxane, or toluene, 35. The process of claim 34 which comprises first making a solution of the resin in the solvent.

36. The process of claim 35 which comprises prior to depositing the coating, the steps of preparing the catalyst solution and the electroless nickel plating solution and mixing the resin and nickel solutions, then after depositing the mixture and drying the film to leave residual solvent therein, immersing the film in the catalyst solution to coat the film, plating nickel onto the catalytic layer, and thereafter causing electroless deposition of copper thereon, forming thereby a magnetic conductive layer of copper or nickel over and which adheres to the cobalt.

37. A method of making a magnetic memory member by depositing a conductive layer coating on a substrate, making said conductive layer coating cathodic and electrodepositing a magnetic metal thereon, the improvement comprising:

a. applying to said substrates as a coating a solution of synthetic polymer containing a cyano group, the solution having one solvent therefore which is a high boiling solvent which is less solvent in water than water is in the solvent, the resin solution containing dissolved therein a reductant which is absorbed by the coating;

b. drying the coating until there remains a limited residual amount of solvent;

c. applying an aqeous solution of platinum, palladium or silver salt whereby the palladium, platinum or silver ions are reduced to their metal form by said reductant thereby creating catalytic nuclei in and on the coating surface;

d. applying an electroless solution of copper or nickel ions to chemically plate the copper or nickel in a substantially continuous layer, which tenaciously adheres to the coated substrate at the catalytic nuclei sites, the limited residual amount of solvent being an adequate amount to absorb the reductant; and e. electrodepositing thereon a layer of substantially pure, closely packed hexagonal cobalt which is thin, continuous, uniform and substantially pit-free from an aqueous plating solution containing the cobalt, said layer having a thickness of about 0.05 to 0.5 microns; a smooth surface approximating optical reflectivity; a nominal coercivity of about 200 to 500 Oersteds, an inductance of about 6,000 to 16,000 Gauss and a ratio of remnant induction to saturation induction greater than 0.8 and approaching unity at the extreme, thereby forming a magnetic memory member having improved information density, frequency response and data rate capability without reduction of output amplitude.

38. A method of making a magnetic memory member by depositing a conductive layer coating on a substrate, making said conductive layer coating cathodic and electrodepositing a magnetic metal thereon, the improvement comprising:

a. applying to said substrate as a coating a solution of synthetic polymer containing a cyano group, the solution having one solvent therefore which is a high boiling solvent which is less solvent in water than water is in the solvent, the resin solution containing dissolved therein (1) a gold or silver salt, or (2) a palladium or platinum salt, b. drying the coating until there remains a limited residual amount of solvent;

c. applying an electroless solution of copper ions containing a reductant thereto whereby the gold or silver salts are reduced, or applying an electroless solution of nickel ions containing a reductant whereby the palladium or platinum is reduced, thereby creating catalytic nuclei to tenaciously retain the chemically plated copper or niclel, respectively to form a substantially continuous layer of copper or nickel, the limited residual amount of solvent being an adequate amount to absorb the reductant; and d. electrodepositing thereon a layer of substantially pure closely packed hexagonal cobalt which is thin, continuous, uniform and substantially pit-free from an aqeous plating solution containing the cobalt, said layer having a thickness of about 0.05 to 0.5 microns; a smooth surface approximating optical reflectivity; a nominal coercivity of about 200 to 500 Oersteds; an inductance of about 6,000 to 16,000 Gauss and a ratio of remnant to saturation induction greater than 0.8 and approaching unity at the extreme, thereby forming a magnetic memory member having improved information density, frequency response and data rate capability without reduction of output amplitude.

39. The process of claim 38 wherein the copper solution is applied, thereby reducing the gold or silver.

40. The process of claim 38 wherein the nickel solution is applied, thereby reducing the palladium or platinum.

* * * * *